United States Patent [19]

Sylla et al.

[11] Patent Number: 4,934,608

[45] Date of Patent: Jun. 19, 1990

[54] PROCESS FOR THE EXPLOSIVE COMMINUTION OF CELLULAR MATERIAL

[75] Inventors: Klaus F. Sylla, Bremen; Ulrich Grunhoff, Bad Honningen, both of Fed. Rep. of Germany

[73] Assignee: Kohlensaurewerk Deutschland GmbH, Bad Honningen, Fed. Rep. of Germany

[21] Appl. No.: 360,978

[22] Filed: Jun. 2, 1989

[30] Foreign Application Priority Data

Jun. 3, 1988 [DE] Fed. Rep. of Germany ..... 3818915

[51] Int. Cl.[5] ..... B02C 19/12

[52] U.S. Cl. ..... 241/1; 241/5

[58] Field of Search ..... 241/DIG. 14, 1, 5, 40, 241/29, 301, 152 A, 65, 23; 99/472, 475

[56] References Cited

U.S. PATENT DOCUMENTS 4,132,161 1/1979 Helwig .
4,746,071 5/1988 Gruenhoff et al. .

FOREIGN PATENT DOCUMENTS 3231465 3/1984 Fed. Rep. of Germany ..... 241/1
3347152 7/1984 Fed. Rep. of Germany .

*Primary Examiner*—Mark Rosenbaum
*Attorney, Agent, or Firm*—Foley & Lardner, Schwartz, Jeffery, Schwaab, Mack, Blumenthal & Evans

[57] ABSTRACT

A process for explosive comminution of cellular material in which the material is subjected to compressed gas in a pressure chamber and then discharged from the pressure chamber with explosive pressure release in small portions against the grinding means of a mill.

15 Claims, 1 Drawing Sheet

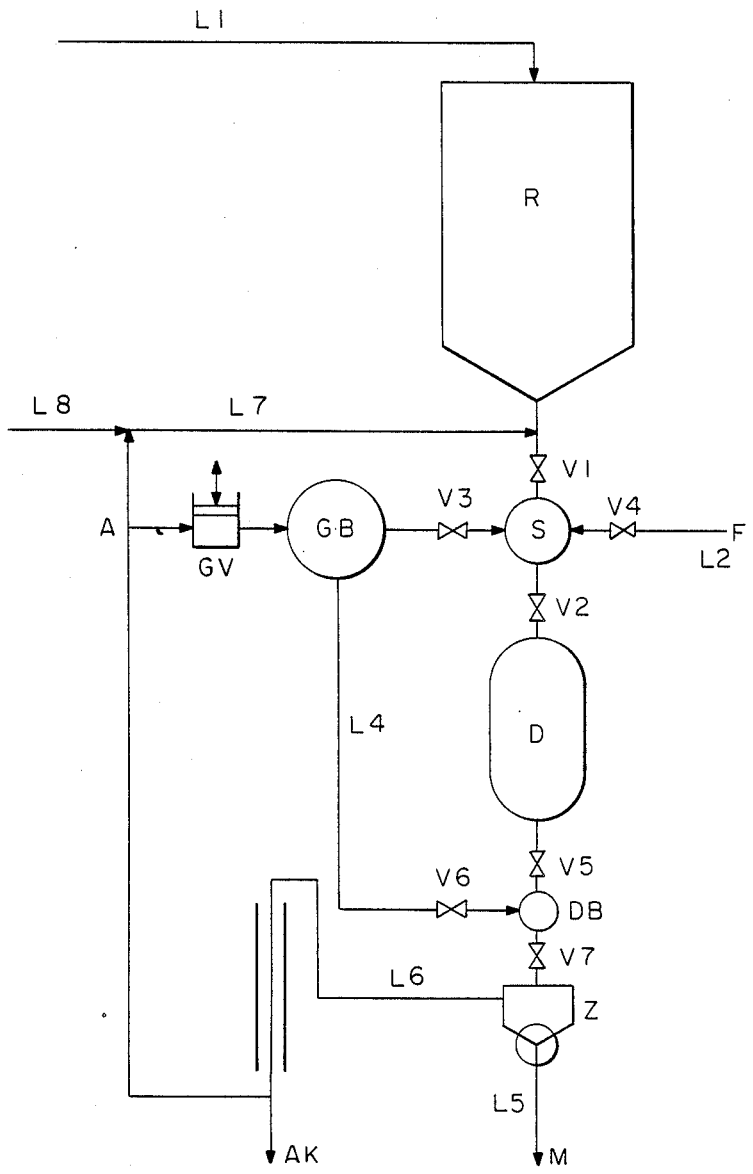
L1
R
L8
L7
V1
V3
V4
A
G·B
S
F
GV
L2
V2
L4
D
V5
V6
DB
V7
L6
Z
L5
AK
M

PROCESS FOR THE EXPLOSIVE COMMINUTION OF CELLULAR MATERIAL

BACKGROUND OF THE INVENTION

This invention relates to a process for the explosive comminution of cellular material of animal or plant origin, in which the material is introduced into a pressure chamber, subjected to compressed gas therein, and then discharged from the pressure chamber with explosive pressure release against an impact surface.

Such a process and apparatus suitable for the performance thereof are described in U.S. Pat. No. 4,132,161. According to this document, it is known that the disintegration of the cellular material can be promoted by the material which is to be disintegrated hitting an impact surface upon pressure release and discharge.

According to the findings on which the invention is based, the impact against the impact surface imparts to the particles a mechanical impetus. Often only this starts the bursting process causing the comminution. At the beginning of the pressure release or discharge step, the particles hit the free, hard wall of the impact surface and actually receive the mechanical impetus. In the course of the pressure release or discharge step, however, a layer of comminuted particles forms on the impact surface. This causes the subsequent particles to hit this comparatively softer layer on the impact surface, so that they no longer receive a mechanical impetus which triggers the bursting process. Moreover, the subsequent particles no longer have the kinetic energy of the initially impacting particles due to continuing discharge of the pressure chamber and the consequent decrease in the pressure difference. As a result thereof, the bursting of the material particles which impact consecutively does not take place uniformly, and a material is obtained which contains coarse fractions as well as fine fractions.

However, the recovery of the components of a material is easier, the smaller the proportion of coarse fractions. Moreover, often a material with too great a variation of particle size is not wanted. Therefore, in prior art processes the coarse material was separated from the fine material, e.g., by sieving, and was recycled to explosive comminution. This causes corresponding expenses and may involve losses of valuable components. Even with repeated recycling of the coarse fraction, complete comminution of the material used cannot be achieved. This is explained by the fact that the recycled material is structurally damaged, and upon pressure release the pressure compensation takes place without a bursting process and hence without the desired comminution effect. If attempts are made to reduce the proportion of coarse material by increasing the pressure, however, there results such fine material that further processing may be made more difficult due to formation of fine dust, clogging of filters, etc.

SUMMARY OF THE INVENTION

An object of the invention is to provide an improved process of explosive comminution which overcomes the drawbacks of the known processes.

This is achieved according to the invention in that the material is discharged or undergoes pressure release in small portions against the grinding means of a mill as an impact surface.

The advantage of such a method is first that any coarse material which may still occur despite explosive comminution is immediately comminuted by the mill, so that at last coarse material does not occur at all and in this respect separation or recycling can be dispensed with. Furthermore, the moving grinding means of the mill in conjunction with the small portions which are supplied ensure that the impacting material continuously meets with free, hard impact surfaces, namely the grinding attachments of the mill and, if the bursting process had not been triggered automatically, it is triggered by the mechanical impetus imparted upon hitting the grinding means.

BRIEF DESCRIPTION OF THE DRAWING

The invention will be explained in further detail hereinafter with reference to the accompanying FIG. 1, which is a schematic representation of an illustrative apparatus suitable for carrying out the process of the invention.

DETAILED DESCRIPTION OF PREFERRED EMBODIMENTS

As used herein, the term "small portions" is understood to refer to portions which can be carried through or processed by the mill used within the period of time required by a material particle which has not been burst by itself to compensate for the pressure difference between the interior of the cell and the outer atmosphere at the moment it emerges from the pressure chamber. This period differs from material to material, but is generally of the order of magnitude of about one minute. Thus, "small portions" in the sense of the invention are portions which can be throughput by the mill used within the period of time required for a material particle which has not burst to undergo pressure compensation.

Suitable mills which may be used in the process according to the invention are known per se. Mills which have a large throughput rate are preferred. Disc mills, in particular toothed disc mills, have proved particularly suitable.

As a rule, it is desirable that the cellular material of animal or plant origin which is to be disintegrated should not come into contact with air or oxygen and/or moisture after comminution. In a preferred embodiment, the process according to the invention therefore makes provision for the material to be discharged or undergo pressure release into an inert gas atmosphere or against an inert gas atmosphere. This is achieved in the simplest case by making the connection between the pressure chamber and the mill gas-tight. This effectively excludes the ingress of air or oxygen and/or moisture. This is particularly the case if, according to another embodiment of the invention, gases such as carbon dioxide, nitrogen, nitrous oxide, noble gases and mixtures of these gases, preferably carbon dioxide, are used as compressed gases. These gases act as inert gases, which according to the invention are understood to be gases which do not undergo any chemical or enzymatic reactions with the cellular material and/or its components.

According to another embodiment of the process of the invention, the cellular material which is to be comminuted is additionally cooled. This cooling may prevent the loss, for instance, during the explosive comminution, of aroma constituents of the cellular material which have a low boiling point and thus are readily volatile. The manner in which the cooling of the material to be comminuted is carried out is known per se to a person skilled in the art, for instance from DE-OS 33 47 152.

The cooling may take place indirectly, e.g., by previous storage of the cellular material which is to be comminuted in cooling devices, and/or by cooling parts of devices using known cooling apparatus. Furthermore, provision may be made for cooling of the grinding attachments of the mill etc.

However, direct cooling of the material which is to be comminuted is preferred. It preferably takes place by direct contact of the cellular material which is to be comminuted with an inert cooling medium, preferably with cold carbon dioxide or nitrogen. In this case the cooling medium is used in a quantity of from about 0.1 to about 40 weight-%, relative to the cellular material.

The inert cooling medium may be used as a gas phase or, preferably, as a condensed phase, e.g., as nitrogen or carbon dioxide in liquefied form. The use of carbon dioxide in solid form is preferred. Both dry ice and solid carbon dioxide in compressed form (carbon dioxide pellets) can be used as solid carbon dioxide.

The cooling medium used for direct cooling may be supplied to the material which is to be comminuted upstream of and/or in the pressure chambers or pressure loading chambers by separate supply means.

The compressed gas which is released in the process according to the invention upon the discharge or pressure release of the material which is to be comminuted against the grinding attachments of a mill may be discharged into the environment, optionally after separation of any volatile constituents taken up from the material by the gas.

In one preferred embodiment of the process according to the invention, provision is made for the compressed gas to be recycled, optionally after separation of volatile constituents which it has taken up.

The manner in which the separation of the volatile constituents from the material takes place is known to a person skilled in the art. For instance, the compressed gas may be separated by passage over suitable absorption agents and then recycled. It is also possible to condense volatile constituents in separators by means of changes in pressure and/or temperature.

The compressed gas, which optionally has been freed from any volatile constituents entrained therein, may be conveyed to a gas storage vessel and thus stored for re-use as a compressed gas or as a cooling medium in the process of the invention.

The compressed gas—optionally in the form of a diverted partial flow—may serve to wash the cellular material which is to be disintegrated, pipes, parts of the apparatus, packing machines and/or to produce the inert gas atmosphere against which the material undergoes pressure release. The contact of the cellular material with air or oxygen and/or moisture can be effectively decreased by this method, optionally in conjunction with the gas-tight construction of the connecting parts of the device used.

In the simplest manner, the process according to the invention can for instance be carried out so that the material which is to be comminuted is introduced into a pressure chamber in portions which are sized according to the invention, subjected to compressed gas in the pressure chamber, and the entire contents of the pressure chamber thereafter are discharged or undergo pressure release against the grinding means of a mill. However, in the process according to the invention this particularly simple method is less preferred.

It has been demonstrated in tests that in pressure expansion processes the comminution effect is particularly good when the subjection of the material to compressed gas lasts over a certain period of time. This period depends on the cellular material. Soft materials having a larger proportion of liquid require shorter periods; harder materials with a lower proportion of liquid require somewhat longer periods. As a rule, holding times of about one minute are sufficient for cellular materials having very different types of structure. However, in the simple method described above, this holding time necessitates a certain idle time of the mill, as material to be comminuted is only supplied to the mill during the discharge phase or pressure release phase of the pressure chamber, but not in the two other operational phases through which the pressure chamber has to pass, i.e. the build-up of pressure and the holding time.

In another embodiment of the invention the material to be comminuted is introduced into a suitably-sized pressure chamber in fairly large portions, subjected to compressed gas, and then discharged or pressure released against the grinding gear of a mill in small portions. The portioning may take place, for instance, using valves which have a very short opening time and only allow portions which are sized according to the invention to pass, which then impact on the grinding means of the mill. In this embodiment, the holding time only needs to be expended once for the large storage portion.

A further embodiment involves use of a plurality of pressure chambers associated with a single mill, and the individual pressure chambers are cyclically filled in succession with material to be comminuted and compressed gas, subjected to the holding time and then discharged or undergo pressure release against the grinding means of the mill. Since about 15 seconds are required for the pressure release process and for the throughput of a portion in the process according to the invention, and since the time for introducing the pressure can be ignored, at a holding time of about one minute, four pressure chambers need to be provided for one mill so that this mill is used to capacity.

Another preferred embodiment of the process according to the invention is characterized in that the material to be comminuted is introduced into a pressure loading chamber, subjected to compressed gas in the pressure loading chamber, transferred from the pressure loading chamber into a pressure chamber while maintaining the pressure, and then discharged or undergoes pressure release from the pressure chamber. Advantageously, the material is introduced into the pressure loading chamber in a relatively large quantity and is transferred therefrom into the pressure chamber in portions, for instance through suitable valves. In this embodiment too, the idle time of the mill is essentially no longer dependent on the holding time.

In a particularly preferred embodiment, the cellular material which is to be comminuted is introduced into a pressure loading chamber, transferred cyclically therefrom into a succession of pressure chambers and is discharged or undergoes pressure release cyclically from the respective pressure chambers in succession. This embodiment permits a high throughput of material with a particularly short idle time of the mill.

A very particularly preferred embodiment of the process according to the invention is characterized in that the material to be comminuted is subjected to compressed gas in a lock chamber, and is transferred into one or more pressure loading chambers while maintaining the pressure. If the flows of material which are supplied to the pressure loading chamber or removed from the pressure loading chamber into the pressure chamber or pressure chambers via the lock chamber correspond to each other, it is possible for the process to be performed continuously. Such a continuous performance of the process permits optimum use of the device.

The pressure range in which the process according to the invention operates is mainly dependent on the cellular material and the desired degree of comminution. The pressure range which is most favorable in each case may easily be determined by simple tests. For instance, when using $CO_2$ as a compressed gas and coffee as the material to be comminuted, the process is preferably carried out at a pressure of about 25 to 35 bar absolute.

In the process according to the invention, "plurality" of pressure loading chambers or pressure chambers is understood to mean 2, 3, 4, 5, 6 or more chambers. A person skilled in the art can easily determine the suitable number of pressure chambers to be provided, if necessary using tests. The number of chambers needed depends, inter alia, on the desired throughput rate of the material, on the capacity of the pressure chambers used, on the type and capacity of the mill used, on the feed material used in each case, on the magnitude of the pressure difference upon pressure release, on the space available for the unit, etc.

In the process according to the invention, optionally processed, e.g., sterilized, air may be used as the compressed gas, if damaging effects on the material which is to be disintegrated are not feared or can be ignored. Preferably, however, inert gases such as carbon dioxide, nitrogen, nitrous oxide, noble gases or mixtures of these gases are used as the compressed gas. Carbon dioxide is distinguished from other usable compressed gases, for instance, by its ability to render the material to be comminuted inert to undesired degradation reactions, by its bacteriostatic effect and by its harmlessness in accordance with applicable food laws.

A person skilled in the art can easily determine, by means of simple, preliminary tests, the sizing of the portions in which the material to be comminuted in the process of the invention is to be discharged or undergo pressure release against the grinding means of a mill by taking into account the given limiting conditions, e.g., the nature of the cellular material to be comminuted, the pressure to which the material is subjected, the type and capacity of the mill used, the maximum permissible coarse fraction, etc. The decisive factor is that the time span between the emergence from the pressure chamber and the impacting and entry into the grinding attachment for a substantial part of the material is not longer than the time required for pressure compensation by unbroken cells, e.g. about 60 seconds for most materials.

The process according to the invention can be used to comminute cellular materials of animal or plant origin. Suitable cellular materials of animal origin may include cells or cell structures of microorganisms or parts of animal tissue or of animal organs. In particular, suitable materials of plant origin may include both parts of plants growing underground, such as roots or legumes, and parts of plants growing above ground, such as flowers, fruits and/or seeds.

Preferably cellular material is used which contains pharmaceutically and/or cosmetically active components, or fats, oils, or waxes, or aromas. In particular, parts of known medicinal or curative plants which contain pharmaceutically and/or cosmetically active components may be utilized as cellular material to be comminuted. Examples of such materials which may be mentioned include fennel, hawthorn, senna, gentian, poppy or valerian. Examples of cellular materials which contain fat, oil or wax, include in particular fruits or seeds of cultivated plants. These contain mixtures of esters or unsaturated or saturated glycerides, which are known, for instance, as coconut, groundnut, linseed, soya, sunflower or jojoba oils.

Suitable cell materials which contain aromas, i.e. components which appeal to the organs of taste and/or smell, include parts of plants, particularly leaves, fruits, flowers and/or seeds, which after appropriate preparation may be used as spices, flavorings or foods or beverages, or for the production thereof. Specific examples of such materials which may be mentioned include tarragon, coriander, caraway, marjoram, nutmeg and mace, pepper, pimento, vanilla, cinnamon, and, as a consumable beverage, coffee beans. Preferably, the process according to the invention is used to comminute roasted coffee.

The process according to the invention has surprising advantages compared with the processes of the prior art. For instance, the fraction of coarse material, which hitherto has had to be sieved out and recycled, which involved additional costs and losses of components, is substantially decreased in the process according to the invention. The bursting forces upon explosive comminution are surprisingly better utilized than in conventional processes due to the discharge of the material to be comminuted in portions against the grinding means of a mill which always remain free. If the mill is a toothed disc mill, in addition to the large capacity, there is the additional advantage that it is possible to control the upper limit of the particle size of the comminuted material as needed by suitable adjustment of the mill.

A further advantage is that when using an inert gas, preferably $CO_2$, as a compressed gas, the cellular material can be processed with the exclusion of air/atmospheric moisture. This inert gas atmosphere can be produced—particularly economically by using recycled waste gas—in optional prior treatment stages, such as classification, sieving, drying, roasting etc., and can be maintained during the comminution operation until packing.

The effect of the process according to the invention is particularly surprising. If cellular material is subjected to explosive comminution in the conventional manner, and coarse material is sieved out, optionally after multiple recyclings, and is ground sometime later, —apart from the loss of components—the comminuting effect of the mill is less than in the process according to the invention. If the material is first ground and then the ground material is subjected to explosive comminution, completely unsatisfactory results are obtained. The surprising effect of the process according to the invention cannot therefore be explained by simple combination of explosive comminution and grinding.

The invention will now be explained with reference to the following non-limiting example schematically illustrated by FIG. 1. A process embodiment was selected in which the material to be comminuted was introduced into a pressure loading chamber via a lock-chamber, was cyclically and consecutively transferred from the pressure loading chamber into a plurality of pressure chambers, and was again cyclically and consecutively discharged or underwent pressure release therefrom into the inlet of a toothed disc mill, a partial stream of the waste gas, after condensation of the components entrained therewith, being used to rinse feed pipes, storage chambers, pressure loading chambers and packaging devices, and the remaining stream being supplied to a gas compressor for re-use as a compressed gas. Coffee was selected as the material to be comminuted, and $CO_2$ as the compressed gas. It is, of course, easily possible for a person skilled in the art having knowledge of the invention to conceive of variations of this illustrative embodiment, e.g., by omitting the lock chamber, adding or omitting pressure loading chambers, pressure chambers, use of other cellular materials, other compressed gases, other mills, operating at different pressures, etc., and all such variations are intended to be within the scope of the invention.

EXAMPLE

Comminution of freshly roasted coffee

After the entire apparatus was rinsed with carbon dioxide to produce an inert gas atmosphere, fresh roast coffee was introduced into a roast coffee reservoir R via a conduit L1. The reservoir R is connected to a lock chamber S by a valve V1. The lock chamber S is connected to a pressure loading chamber D by a valve V2. The lock chamber S is connected by a valve V3 to a gas reservoir GB, and by a valve V4 and a conduit L2 to a fresh gas reservoir F. About 12.5 kg freshly roasted coffee beans were removed from the reservoir R, which was under standard pressure, and were transferred into the lock chamber S via the open valve V1; the valves V2, V3 and V4 were closed. Valve V1 was then also closed, V3 was opened, and the coffee beans were subjected to compressed gas from the gas reservoir GB until a desired pressure of about 30 bar (absolute) was achieved. After valve V3 had been closed, valve V2 was opened, and the contents of the lock chamber S were transferred into the pressure loading chamber D, in which there was also a pressure of about 30 bar (absolute). Subsequently the valve V2 was closed again and the lock chamber was re-filled, the overpressure in the lock chamber, compared with the reservoir, having previously been reduced by means (not shown), e.g., a conduit to a gas compressor GV. The operation of filling and emptying the lock chamber was repeated approximately every 3 minutes. The pressure loading chamber D has a capacity of about 500 liters. It is connected to four pressure chambers DB, which each have a capacity of about 1 liter, by four valves V5. Each of the pressure chambers DB is connected to the gas reservoir GB by a valve V6 and a conduit L4, and to the inlet of a toothed disc mill Z by a reversible ball valve V7. For ease of illustration, only one of each of valves V5, pressure chambers DB, conduits L4 and ball valves V7 is shown in the drawing.

Initially, all the valves V5, V6 of the pressure chambers DB and the ball valves V7 were closed. The pressure chambers DB were subjected to compressed gas via the conduits L4 by opening the valves V6, until a desired value of abut 30 bar (absolute) was achieved. After closing the valves V6, first one of the valves V5 was opened, and an approximately 250 g portion of roast coffee from the pressure loading chamber D was transferred into the associated pressure chamber DB, whereupon the valve V5 was closed again. In a similar manner, about 250 g of roast coffee was cyclically introduced into each of the pressure chambers DB in succession. After the introduction of the roast coffee and closing of the associated valve V5, the ball valve V7 of the first pressure chamber DB was switched to the open position, and its contents were discharged explosively into the inlet of the toothed disc mill Z. In the same manner, all the pressure chambers DB were cyclically discharged in succession into the inlet of the toothed disc mill Z.

The process of subjecting the pressure chambers to compressed gas, introducing the roast coffee and pressure release discharging the pressurized coffee into the toothed disc mill was continuously repeated cyclically by appropriate opening and closing of the respective valves. In this way, the pressure chambers were each filled and discharged again four times within approximately one minute.

The toothed disc mill and inlet are connected to each other and to the ball valve V7 so as to be gas-tight, in order to prevent the ingress of air. The material discharged into the inlet of the toothed disc mill was completely passed through the grinding gear of the mill within about 15 seconds. The ground material M, which was free of unwanted coarse fractions, was supplied to a packaging device (not shown) via a conduit L5, in which a $CO_2$ atmosphere was maintained. The $CO_2$ which was released upon pressure release was initially conducted out of the mill via a conduit L6 into a separator AK for aroma condensation. The gas which was freed of condensate was recycled to the gas compressor GV, a diverted partial flow thereof being used via a conduit L7 for rinsing the coffee reservoir R and for rinsing the conduit L1. Inevitable, slight losses of compressed gas were restored by fresh gas via the conduits L2 and L8. The aroma condensate from separator AK was added to the ground material before packaging.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. A process for the explosive comminution of cellular material of animal or plant origin, in which the material is introduced into a pressure chamber connected to a mill having grinding means, subjected to compressed gas in said pressure chamber, and then discharged from the pressure chamber with explosive pressure release directly against the grinding means of said mill as an impact surface, wherein the material is discharged or undergoes pressure release against said grinding means in portions which are sufficiently small that each portion can be throughput by said mill within the period of time required for a material particle which has not burst to undergo pressure compensation.

2. A process according to claim 1, wherein the discharge or pressure release is carried out against the grinding means of a disc mill.

3. A process according to claim 2, wherein said disc mill is a toothed disc mill.

4. A process according to claim 1, wherein the discharge or pressure release is effected into an inert gas atmosphere.

5. A process according to claim 1, wherein the material is additionally cooled.

6. A process according to claim 1, wherein the compressed gas is recycled.

7. A process according to claim 6, wherein volatile constituents taken up by the compressed gas from the material being comminuted are separated from the gas before it is recycled.

8. A process according to claim 1, wherein the material is introduced into a pressure loading chamber, is subjected therein to compressed gas, is transferred from the pressure loading chamber into a said pressure chamber while maintaining the pressure, and is discharged or undergoes pressure release from the pressure chamber.

9. A process according to claim 8, wherein the material is transferred cyclically from the pressure loading chamber into a plurality of pressure chambers in succession and is discharged or undergoes pressure release cyclically from said pressure chambers in succession.

10. A process according to claim 8, wherein said compressed gas comprises carbon dioxide.

11. A process according to claim 1, wherein said compressed gas is selected from the group consisting of carbon dioxide, nitrogen, nitrous oxide, noble gases and mixtures thereof.

12. A process according to claim 1, wherein in a continuous process the material is introduced into a lock chamber, subjected to compressed gas and introduced into at least one further pressurized chamber while maintaining the pressure.

13. A process according to claim 12, wherein said material is introduced from said lock chamber into a pressure loading chamber.

14. A process according to claim 12, wherein said material is introduced from said lock chamber into a plurality of pressure loading chambers.

15. A process for grinding roast coffee comprising the steps of introducing roast coffee into a pressure chamber connected to a mill having grinding means, subjecting the roast coffee in said pressure chamber to compressed gas, and then discharging the roast coffee and compressed gas from the pressure chamber with explosive pressure release directly against the grinding means of said mill as an impact surface, wherein said coffee id discharged against said grinding means in portions which are sufficiently small that each portion can be throughput by said mill within the period of time required for a material particle which has not burst to undergo pressure compensation.

* * * * *